US011371179B2

(12) United States Patent
Seo et al.

(10) Patent No.: US 11,371,179 B2
(45) Date of Patent: Jun. 28, 2022

(54) DRAINAGE PUMP AND CLOTH TREATING APPARATUS INCLUDING SAME

(71) Applicant: LG Electronics Inc., Seoul (KR)

(72) Inventors: Sanghoon Seo, Seoul (KR); Daejin Kim, Seoul (KR); Minhyeok Park, Seoul (KR); Jinsub Lim, Seoul (KR); Moonsik Choi, Seoul (KR)

(73) Assignee: LG Electronics Inc., Seoul (KR)

( * ) Notice: Subject to any disclaimer, the term of this patent is extended or adjusted under 35 U.S.C. 154(b) by 195 days.

(21) Appl. No.: 16/709,196

(22) Filed: Dec. 10, 2019

(65) Prior Publication Data

US 2020/0362503 A1 Nov. 19, 2020

(30) Foreign Application Priority Data

May 14, 2019 (KR) ..... 10-2019-0056627

(51) Int. Cl.

| | |
|---|---|
| ***D06F 39/08*** | (2006.01) |
| *D06F 25/00* | (2006.01) |
| *D06F 39/12* | (2006.01) |
| *F04D 13/06* | (2006.01) |
| *F04D 29/66* | (2006.01) |

(52) U.S. Cl.

CPC ..... *D06F 39/085* (2013.01); *D06F 39/088* (2013.01); *D06F 25/00* (2013.01); *D06F 39/12* (2013.01); *F04D 13/06* (2013.01); *F04D 29/669* (2013.01)

(58) Field of Classification Search

CPC ..... D06F 39/085

See application file for complete search history.

(56) References Cited

U.S. PATENT DOCUMENTS

2002/0100299 A1 8/2002 Junk et al.
2008/0250820 A1 10/2008 Cimetta et al.

(Continued)

FOREIGN PATENT DOCUMENTS

CN 105422511 3/2016
DE 10 2014 222050 3/2016

(Continued)

OTHER PUBLICATIONS

Extended European Search Report in European Appln. No. 19211792.7, dated Apr. 29, 2020, 8 pages.

(Continued)

*Primary Examiner* — Jason Y Ko

(74) *Attorney, Agent, or Firm* — Fish & Richardson P.C.

(57) ABSTRACT

A drainage pump includes a housing that defines a receiving space configured to receive fluid. The housing defines a suction port configured to introduce fluid into the receiving space, and a first discharge port and a second discharge port that are configured to discharge the fluid in the receiving space to an outside of the housing. The drainage pump further includes an impeller disposed in the receiving space and configured to rotate about a rotation axis to thereby discharge the fluid in the receiving space through the first discharge port or the second discharge port; a first rib that protrudes from an inner circumferential surface of the housing toward a center of the receiving space and that is disposed between the first discharge port and the second discharge port; and a second rib that protrudes from a portion of the first rib toward the center of the receiving space.

20 Claims, 12 Drawing Sheets

(56) References Cited

U.S. PATENT DOCUMENTS

| | | | |
|---|---|---|---|
| 2012/0114473 | A1 | 5/2012 | Badafem et al. |
| 2018/0073186 | A1 | 3/2018 | Choi et al. |

FOREIGN PATENT DOCUMENTS

| | | |
|---|---|---|
| EP | 3293304 | 3/2018 |
| JP | H08105400 | 4/1996 |
| KR | 20080059432 | 6/2008 |
| KR | 10-1626896 | 6/2016 |
| KR | 20180082897 | 7/2018 |
| WO | WO2016066485 | 5/2016 |

OTHER PUBLICATIONS

Korean Office Action in Korean Appln. No. 10-2019-0056627, dated Apr. 28, 2020, 100 pages (with English translation).
Korean Notice of Allowance in Korean Appln. No. 10-2009-0056627, dated Oct. 15, 2020, 11 pages (with English translation).
Office Action in Chinese Appln. No. 201910973971.7, dated May 6, 2022, 14 pages (with English translation).

DRAINAGE PUMP AND CLOTH TREATING APPARATUS INCLUDING SAME

CROSS-REFERENCE TO RELATED APPLICATIONS

The present application claims priority under 35 U.S.C. 119 and 35 U.S.C. 365 to Korean Patent Application No. 10-2019-0056627, filed on May 14, 2019, which is hereby incorporated by reference in its entirety.

TECHNICAL FIELD

The present disclosure relates to a drainage pump and a cloth treating apparatus including the same.

BACKGROUND

A cloth treating apparatus may remove contamination of laundry by putting clothes, bedding, or the like into a drum, and perform processes such as washing, rinsing, dewatering, and drying, for example.

The cloth treating apparatus may be divided into a top loading system and a front loading system based on a method of putting laundry into a drum. In some examples, the front loading type cloth treating apparatus may be referred to as a drum washing machine.

In some examples, the drum washing machine may perform, when laundry is received in the drum and water is supplied to the drum, a washing process through rotation of the drum, and after the process such as rinsing and dewatering, the water or wash water may be discharged to an outside.

In some examples, the drum washing machine may include a circulation pump for circulating water in the drum during the washing process and a drainage pump for discharging water or wash water generated through the washing process to the outside.

In some cases, the drainage pump may perform roles of the circulation pump and the drainage pump using a method of switching a rotation direction of an impeller by using one motor and an impeller, which may minimize an installation space of pumps and save product cost.

In some cases, the drainage pump may include a housing for receiving water and a water flow portion disposed on an inner circumferential surface of the housing.

The water flow portion may include an asymmetric rib that protrudes inward from one end of the inner circumferential surface of the water flow portion and that is disposed between a first discharge port and a second discharge port.

In some cases, a backflow phenomenon may be generated in the circulation process of circulating the water inside the drum and the drainage process of discharging the wash water to the outside of the drum. For instance, the backflow phenomenon may include an event where water or wash water is discharged to an outside of the drum during the circulation process of circulating the water to the drum, and an event where water or wash water flows into the drum in the drainage process of discharging the wash water in the drum to the outside of the drum.

In some cases, the backflow phenomenon may be mitigated by reduction of the number of revolutions of the drain motor, where the flow (discharge) performance of the water may be lowered, and the suction flow rate may be reduced.

SUMMARY

The present disclosure describes a drainage pump that can prevent backflow of water in a circulation process and a drainage process of a drainage pump, and a cloth treating apparatus including the same.

The present disclosure also describes a drainage pump that can prevent backflow of water in a circulation process and a drainage process of the drainage pump and that can secure a minimum required flow rate, and a cloth treating apparatus including the same.

The present disclosure also describes a drainage pump that can minimize vibration and noise generated in the circulation process and the drainage process of the drainage pump, and a cloth treating apparatus including the same.

According to one aspect of subject matter described in this application, a drainage pump includes a housing that defines a receiving space configured to receive fluid. The housing defines a suction port configured to introduce fluid into the receiving space, and a first discharge port and a second discharge port that are configured to discharge the fluid in the receiving space to an outside of the housing. The drainage pump further includes an impeller disposed in the receiving space and configured to rotate about a rotation axis to thereby discharge the fluid in the receiving space through the first discharge port or the second discharge port; a first rib that protrudes from an inner circumferential surface of the housing toward a center of the receiving space and that is disposed between the first discharge port and the second discharge port; and a second rib that protrudes from a portion of the first rib toward the center of the receiving space.

Implementations according to this aspect may include one or more of the following features. For example, the impeller may face the suction port, and the first rib may be disposed radially outward of the impeller. In some implementations, the impeller may include a rotation shaft that extends along the rotation axis, and the rotation axis passes through a center of the suction port.

In some implementations, the drainage pump may further include a circulation pipe that extends from the first discharge port to the outside of the housing, and a drainage pipe that extends from the second discharge port to the outside of the housing. In some examples, the first rib may have a first thickness in a radial direction of the housing with respect to the inner circumferential surface of the housing. In some examples, the second rib may extend from an inner surface of the first rib toward the suction port.

In some implementations, the second rib may extend from an inner surface of the first rib to a space defined between the suction port and the impeller. In some implementations, the second rib may extend from an inner surface of the first rib in the radial direction and has a second thickness in the radial direction with respect to the inner surface of the first rib. In some examples, the second thickness of the second rib may be greater than or equal to the first thickness of the first rib.

In some implementations, the second rib may define an inclined surface facing the impeller. In some implementations, the second rib may include: a first surface that contacts an inner surface of the first rib; a second surface that extends from the first surface and that contacts an inner surface of the housing; a third surface that extends from an end portion of the second surface; and a fourth surface that extends from the first surface in a direction inclined with respect to the first surface, that connects to the third surface, and that faces the impeller.

In some examples, the first surface and the fourth surface defines an inclination angle in a range from 15° to 25°. In some examples, an inner diameter of the housing may be in a range from 1.1 to 1.5 times an outer diameter of the impeller. In some examples, an inner diameter of the suction port may be in a range from 0.5 to 0.7 times an outer diameter of the impeller.

In some implementations, a radial distance between an inner surface of the first rib and a center of the suction port or a rotation shaft of the impeller is in a range from 0.8 to 1.0 times an inner diameter of the housing. In some implementations, a radial distance between an inner surface of the second rib and a center of the suction port or a rotation shaft of the impeller is in a range from 0.5 to 0.7 times an inner diameter of the housing.

In some implementations, a sectional area of the suction port increases as the suction port extends from an inlet side facing the outside of the housing to an outlet side facing the impeller. In some implementations, the suction port may define an inflow guide surface at an inside of the suction port, the inflow guide surface having a predetermined curvature. In some examples, a radius of curvature of the inflow guide surface may be in a range from 2 mm to 5 mm.

According to another aspect, a cloth treating apparatus includes: a cabinet that defines an outer appearance of the cloth treating apparatus; a tub disposed inside the cabinet and configured to receive wash water; a drum disposed inside the tub and configured to receive laundry; a pulsator rotatably installed in the drum; a driving unit configured to rotate the pulsator or the drum; and a drainage pump disposed outside the tub and configured to drain or circulate wash water discharged from the tub. The drainage pump includes a housing that defines a receiving space configured to receive fluid. The housing defines a suction port configured to introduce fluid into the receiving space, and a first discharge port and a second discharge port that are configured to discharge the fluid in the receiving space to an outside of the housing. The drainage pump further includes: an impeller disposed in the receiving space and configured to rotate about a rotation axis to thereby discharge the fluid in the receiving space through the first discharge port or the second discharge port; a first rib that protrudes from an inner circumferential surface of the housing toward a center of the receiving space and that is disposed between the first discharge port and the second discharge port; and a second rib that protrudes from a portion of the first rib toward the center of the receiving space.

Implementations according to this aspect may include one of more of the features described above for the drainage pump.

DETAILED DESCRIPTION

Reference will now be made in detail to the implementations of the present disclosure, examples of which are illustrated in the accompanying drawings.

Hereinafter, an example front loading type cloth treating apparatus will be described. The front loading type cloth treating apparatus may include a drum horizontally installed and configured to rotate about a horizontal shaft, where laundry can be put from a front side of the drum.

However, the present disclosure is not limited thereto, and the present disclosure is also applicable to a top loading type cloth treating apparatus in which a drum is vertically provided so that laundry can be put from above, and configured to rotate about a vertical shaft.

Hereinafter, a drainage pump and a cloth treating apparatus including the same will be described in detail with reference to the drawings.

Figure 1:
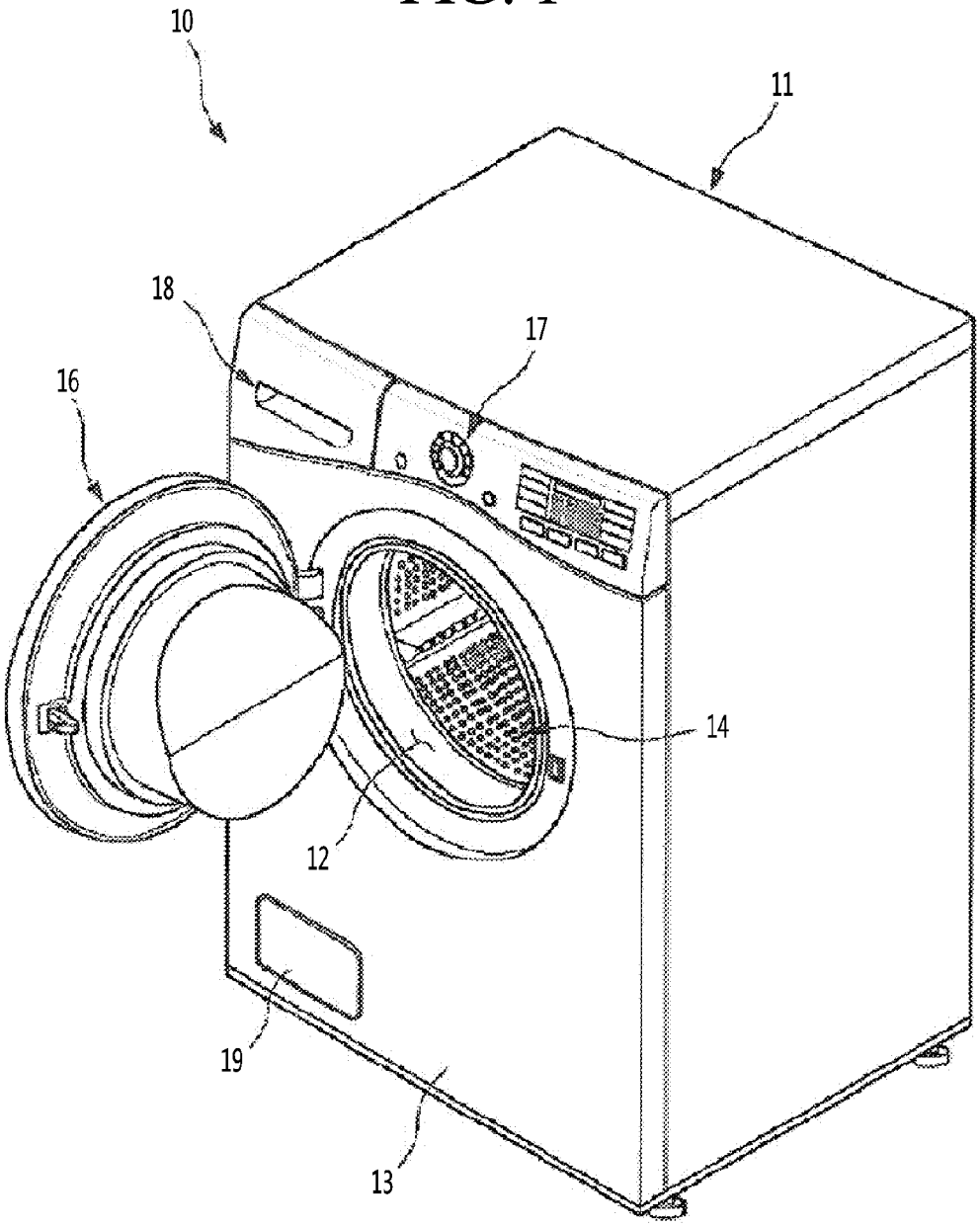
FIG. 1 is a perspective view illustrating an example of a cloth treating apparatus.
Figure 2:
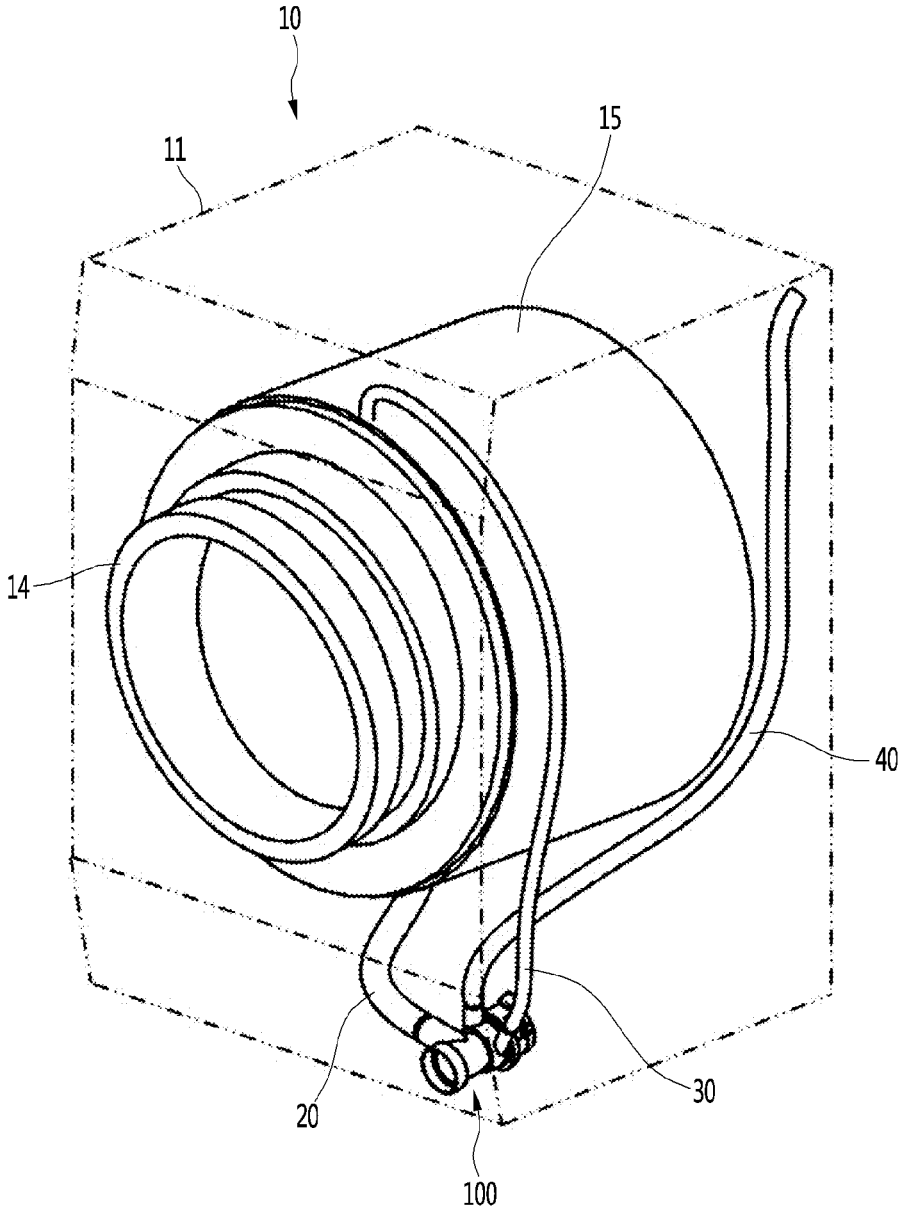
FIG. 2 is a perspective view illustrating an example of an inside of a cloth treating apparatus including a drainage pump.

FIG. 1 is a perspective view illustrating an example of a cloth treating apparatus, and FIG. 2 is a perspective view illustrating an example of an inside of a cloth treating apparatus including a drainage pump.

Referring to FIG. 1 and FIG. 2, a cloth treating apparatus 10 includes a cabinet 11 that define an outer appearance of the cloth treating apparatus 10, a front cover 13 that is mounted on a front surface of the cabinet 11 and that defines a laundry entrance 12, a drum 14 configured to receive laundry, and a tub 15 that accommodates the drum 14 and that is configured to receive water or wash water.

In some implementations, the cloth treating apparatus 10 may further include a motor which provides rotational power to the drum 14.

In some examples, the drum 14 may be understood as an "inner tub" or a "washing tub", and the tub 15 can be understood as an "outer tub" or a "dewatering tub".

In some implementations, the cabinet 11 may have a substantially hexahedral shape.

The cabinet 11 may define one or more spaces for installing a plurality of components. The plurality of components may include, for example, a drum 14, a tub 15, a motor, a water supply device, a drainage device, and a control device.

The front cover 13 may define a laundry entrance 12 configured to receive laundry.

The laundry entrance 12 may be defined at a central portion of the front cover 13. A door 16 for opening and closing the laundry entrance 12 may be rotatably installed on the front cover 13.

A gasket may be provided between the door 16 and the tub 15 to maintain airtightness.

The cloth treating apparatus 10 may further include a control panel 17 provided at an upper end of a front surface of the cabinet 11.

The control panel 17 may include a display for displaying an operation state of the cloth treating apparatus 10. The control panel 17 may be provided with a plurality of buttons or knobs for operating the operation of the cloth treating apparatus 10.

The cloth treating apparatus 10 may further include a detergent drawer 18 provided at an upper end of a front surface of the cabinet 11.

The detergent drawer 18 may be provided on the side of the control panel 17. In the detergent drawer 18, a portion where the detergent is put and stored, and a portion which is exposed to a front surface may be integrally formed.

The detergent drawer 18 may be connected to a water supply pipe to which cold water and hot water are supplied. Cold water or hot water may flow into the detergent drawer 18 from the water supply pipe. The water mixed with at least one of the detergent and fabric softener of the detergent drawer 18 may be supplied into the drum 14 through which the laundry is received via the tub 15.

The cloth treating apparatus 10 may further include a service cover 19 provided at the lower end of the front surface of the cabinet 11.

The service cover 19 is configured so as to be opened in a state where the cloth treating apparatus 10 is stopped and so as to remove residual water present in the cloth treating apparatus 10.

In the drum 14, a washing process in which contamination of the laundry is separated by the action of a detergent and water, a rinsing process of rinsing the laundry by the action of water, and a dewatering process of dewatering laundry by centrifugation are performed.

The drum 14 is provided in a cylindrical shape and is received in the tub 15.

For example, the drum 14 is formed into a cylindrical shape which is laid at a predetermined angle, and a water hole may be formed around the drum 14.

Accordingly, the wash water stored in the tub 15 can flow into the drum 14 through the water hole. In addition, the wash water in the drum 14 can be moved to the outside of the drum 14 through the water hole.

The drum 14 may be provided with a pulsator for inducing flow of wash water into the drum 14.

In the cloth treating apparatus 10, the pulsator is provided inside the drum 14, and a motor for directly rotating the drum 14 and a power transmitting mechanism such as a clutch for transmitting the driving force of the motor to the pulsator or the drum 14 may be mounted on a rear end portion of the tub 15.

The tub 15 contains wash water for washing or rinsing. The tub 15 is provided to receive the drum 14. For example, the tub 15 may be formed in a cylindrical shape.

The tub 15 may be installed in a state of being suspended from the cabinet 11 or the front cover 13. The drum 14 disposed inside the tub 15 is rotatable by the rotational force of the motor.

In some implementations, the cloth treating apparatus 10 further includes a water supply device for supplying wash water to the tub 15 and a drainage device for draining wash water stored in the tub 15 to the outside.

The water supply device may include a water supply pipe connecting the tub 15 with an external water supply facility (for example, a faucet or the like) and a water supply valve for adjusting so as to supply water or not to supply to the tub 15.

The drainage device includes a drainage pump 100 for discharging the water stored in the tub 15 to the outside, and a plurality of hoses 20, 30 and 40 connected to the drainage pump 100.

The drainage pump 100 may be located at an inner lower portion of the cabinet 11. For example, the drainage pump 100 may be installed below the tub 15.

When the water or wash water stored in the tub 15 flows into the drainage pump 100, the drainage pump 100 can perform the circulation process of allowing the water or wash water introduced to be moved by the driving of the motor toward the tub 15 and the drainage process of discharging the introduced water or the wash water to the outside.

The plurality of hoses 20, 30 and 40 include a suction hose 20 for allowing water stored in the tub 15 to flow into the drainage pump 100, a circulation hose 30 for allowing the water flowing into the drainage pump 100 to flow into the tub 15, and a drainage hose 40 for allowing the water flowing into the drainage pump 100 to be discharged to the outside of the cabinet 11.

The suction hose 20 connects one side of the tub 15 and one side of the drainage pump 100. For example, one end of the suction hose 20 may be connected to the lower surface of the tub 15, and the other end thereof may be connected to one side of the drainage pump 100.

The circulation hose 30 connects the other side of the tub 15 and the other side of the drainage pump 100. For example, one end of the circulation hose 30 may be connected to the upper surface of the tub 15, and the other end thereof may be connected to the other side of the drainage pump 100.

One end of the drainage hose 40 may be connected to the drainage pump 100 and the other end thereof may extend outside the cabinet 11.

In addition, the drainage device may further include a drainage valve for adjusting the water stored in the tub 15. For instance, the drainage valve may switch between a first state (e.g., an open state) for draining the water in the tub 15 and a second state (e.g., a closed state) for not draining the water in the tub 15. In some cases, the drainage valve may have an intermediate state (e.g., a partially open state) for partially draining the water in the tub 15.

Figure 3:
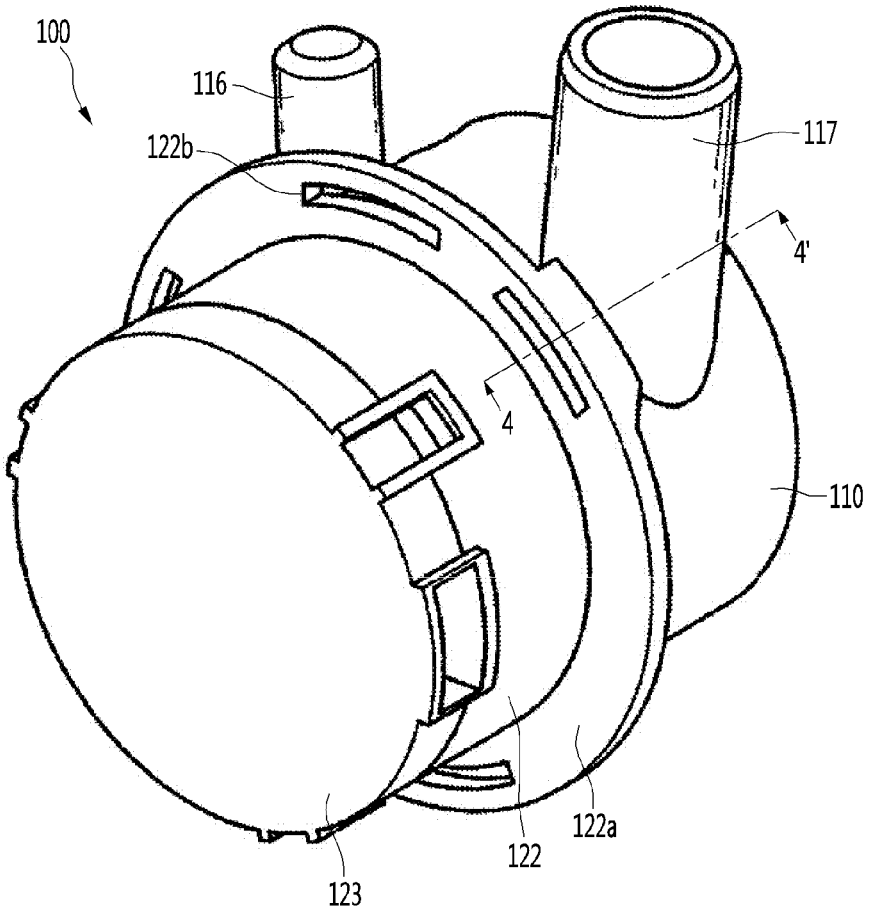
FIG. 3 is a perspective view illustrating an example of a drainage pump.
Figure 4:
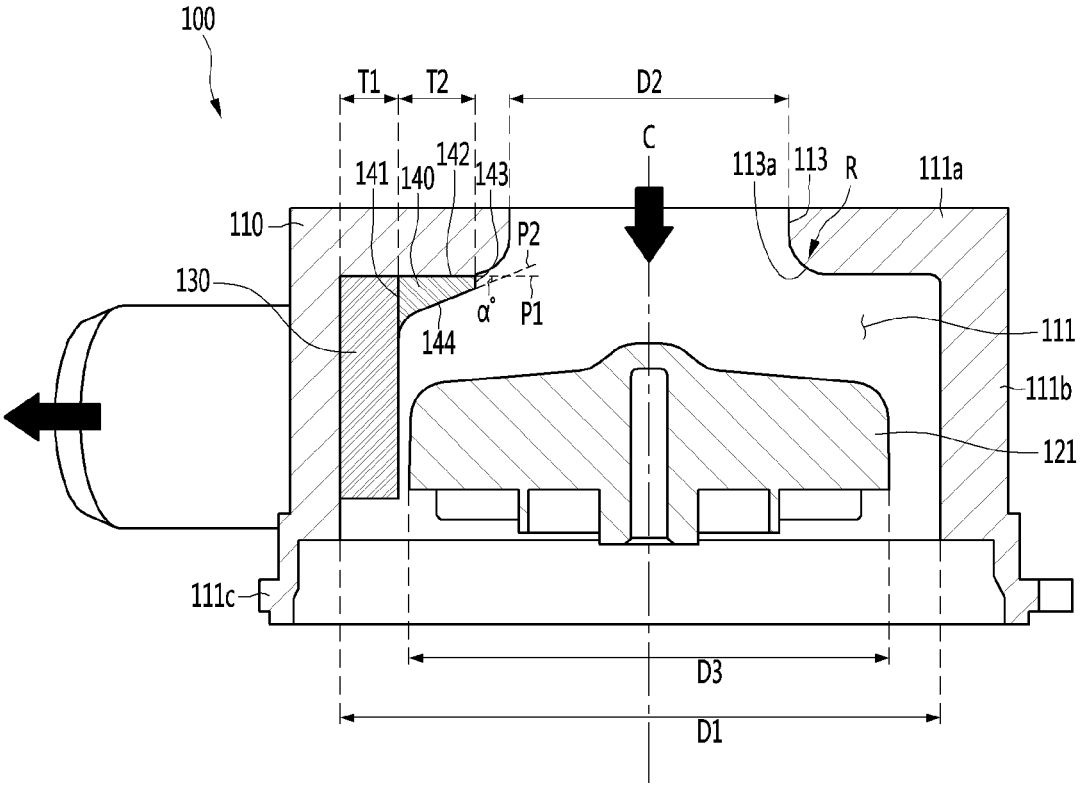
FIG. 4 is a sectional view illustrating a section taken along line 4-4' of FIG. 3.
Figure 5:
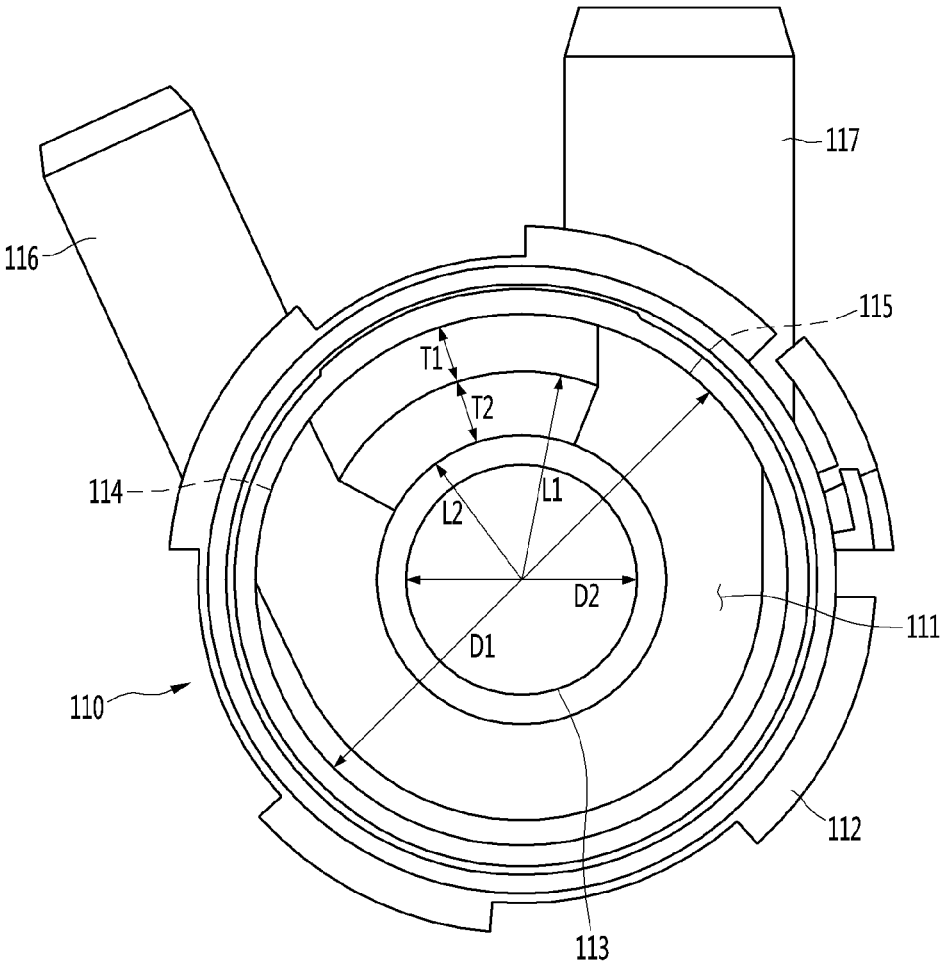
FIG. 5 is a front view illustrating an example of an inside of the housing of the drainage pump of FIG. 3.

FIG. 3 is a perspective view illustrating an example drainage pump, FIG. 4 is a sectional view illustrating a section taken along line 4-4' of FIG. 3, and FIG. 5 is a front view illustrating the inside of the housing of the drainage pump.

Referring to FIG. 3 to FIG. 5, a drainage pump 100 includes a housing 110 forming a receiving space 111 through which fluid flows.

The housing 110 may have a hollow cylindrical shape. The housing 110 may include a plurality of openings 113, 114, and 115 for inflow or outflow of fluid. The plurality of openings 113, 114, and 115 may include a suction port 113, a circulation port 114, and a drainage port 115.

Here, the circulation port 114 is a first passage through which the fluid is discharged and may be referred to as a first discharge port, and the drainage port 115 is a second passage through which the fluid is discharged and may be referred to as a second discharge port.

For the convenience of explanation, the structure of the drainage pump will be described with reference to FIG. 4.

The suction port 113 is formed on the upper surface of the housing 110. The suction port 113 may be formed by passing through from the upper surface of the housing 110 to the receiving space 111. The suction hose 20 is connected to the suction port 113 so that water or wash water stored in the tub 15 may flow into the receiving space 111 of the housing 110 through the suction hose 20.

According to one implementation, the suction port 113 may be formed at the center of the upper surface of the housing 110. The suction port 113 may be formed in a circular shape. The center of the suction port 113 may coincide with the rotation shaft (rotation center) of the impeller 121 to be described below.

The circulation port 114 is formed on a side surface or an outer circumferential surface of the housing 110. The circulation port 114 may be formed by passing through from the side surface or the outer circumferential surface of the housing 110 to the receiving space 111. In addition, the circulation hose 30 is connected to the circulation port 114 so that water existing in the receiving space 111 can flow into the tub 15 through the circulation hose 30.

The circulation port 114 may be disposed at any point on the outer circumferential surface of the housing 110. The circulation port 114 may be formed in a circular shape.

The drainage port 115 may be formed on a side surface or an outer circumferential surface of the housing 110. The drainage port 115 may be formed by passing through from the side surface or the outer circumferential surface of the housing 110 to the receiving space 111. The drainage hose 40 is connected to the drainage port 115 so that water existing in the receiving space 111 can be discharged to the outside of the cabinet 11 through the drainage hose 40.

The drainage port 115 may be disposed at any point on the outer circumferential surface of the housing 110. The drainage port 115 may be formed in a circular shape. The drainage port 115 and the circulation port 114 are spaced apart from each other in the circumferential direction of the housing 110.

In addition, the drainage pump 100 further includes an impeller 121 disposed inside the housing 110 and a motor for providing power for rotating the impeller 121.

The impeller 121 rotates inside the housing 110 to form a flow of fluid (water or wash water) received in the receiving space 111. The impeller 121 rotates clockwise or counterclockwise in the receiving space 111 to form a water flow.

At this time, the water received in the receiving space 111 may be moved to the circulation port 114 or the drainage port 115 in accordance with the rotation direction of the impeller 121. In other words, the flow stream in the receiving space 111 can be determined by a direction of rotation of the impeller 121.

The impeller 121 may be disposed to face the suction port 113 in the housing 110. At this time, the rotation shaft or the rotation center of the impeller 121 may coincide with the center of the suction port 113. Accordingly, the water introduced through the suction port 113 can be moved in a circumferential direction of the impeller 121 after being moved in the axial direction of the impeller 121. The water flowing in the circumferential direction of the impeller 121 can be moved through either the circulation port 114 or the drainage port 115.

The drainage pump 100 further includes a circulation pipe 116 connected to the circulation port 114 and a drainage pipe 117 connected to the drainage port 115.

The circulation pipe 116 extends outward from the outer surface of the housing 110 corresponding to the circulation port 114 by a predetermined length. In other words, the circulation pipe 116 protrudes outward along the edge of the circulation port 114.

The circulation pipe 116 functions to guide the water passing through the circulation port 114 to the circulation hose 30. One end of the circulation hose 30 is connected to the circulation pipe 116 and the other end thereof is connected to the tub 15.

The drainage pipe 117 extends outward from the outer surface of the housing 110 corresponding to the drainage port 115 by a predetermined length. In other words, the drainage pipe 117 protrudes outward along the edge of the drainage port 115.

The drainage pipe 117 functions to guide the water passing through the drainage port 115 to the drainage hose 40. One end of the drainage hose 40 may be connected to the drainage pipe 117 and the other end thereof may be pulled out of the cabinet 11.

The circulation pipe 116 and the drainage pipe 117 may be formed integrally with the housing 110. In other words, the housing 110, the circulation pipe 116, and the drainage pipe 117 may be manufactured by being integrally molded.

In the present implementation, although it is described that the circulation pipe 116 and the drainage pipe 117 exist, the circulation pipe 116 and the drainage pipe 117 may be omitted. In this case, the circulation hose 30 is directly connected to the circulation port 114, and the drainage hose 40 is directly connected to the drainage port 115.

The drainage pump 100 further includes an impeller case 122 for fixing the impeller 121 and the motor.

The impeller case 122 supports the impeller 121 to rotate stably in the housing 110. The impeller case 122 may be coupled to an opened surface of the housing 110 in a state where the impeller 121 is fixed. Accordingly, the impeller 121 can rotate in the housing 110 by being connected to the rotation shaft of the motor and receiving rotational force from the motor.

In addition, the impeller case 122 is coupled to the opened surface of the housing 110 to seal the inside of the housing 110.

A flange portion 122*a* protruding outward is formed on the outer circumferential surface of the impeller case 122. The flange portion 122*a* may be formed to surround the circumferential surface of the impeller case 122 in the circumferential direction.

A protrusion receiving portion 122*b* is formed in the flange portion 122*a*. The protrusion 112 protruding from the outer circumferential surface of the housing 110 may be inserted into and be fixed to the protrusion receiving portion 122*b*. A plurality of protrusion receiving portions 122*b* may be spaced apart from each other along the outer circumferential surface of the flange portion 122*a*.

The drainage pump 100 further includes an impeller case cover 123. The impeller case cover 123 is coupled to the impeller case 122 to limit the external exposure of the impeller 121 and the motor.

More specifically, the housing 110 may be formed with a receiving space 111 in which water or wash water and a surface 111*c* thereof has an opened cylindrical shape. The upper surface 111*a* of the housing 110 is formed with the suction port 113 through which water or wash water flows. The suction port 113 may be located at the center of the upper surface 111*a* of the housing 110.

For example, the housing 110 may include an upper surface 111*a* on which the suction port 113 is formed, a side surface 111*b* extending downward along the edge of the upper surface 111*a*, and an opened lower surface 111*c*. The lower surface 111*c* of the housing 110 may be shielded by the impeller case 122 which fixes the impeller 121.

The impeller 121 is disposed in the receiving space 111 of the housing 110. The impeller 121 is disposed to face the suction port 113. At this time, the rotation shaft or the rotation center C of the impeller 121 may coincide with the center of the suction port 113.

Here, the outer diameter D2 of the suction port 113 is formed to be smaller than the inner diameter D1 of the housing 110. The outer diameter D3 of the impeller 121 is formed to be smaller than the inner diameter D1 of the housing 110 and larger than the outer diameter D2 of the suction port 113.

In the present implementation, a length of the inner diameter D1 of the housing 110 may be 1.1 to 1.5 times a length of the outer diameter D3 of the impeller 121. In addition, a length of the outer diameter D2 of the suction port 113 may be 0.5 to 0.7 times a length of the outer diameter D3 of the impeller 121.

In some implementations, the drainage pump 100 may further include a protrusion 112 for coupling the housing 110 and the impeller case 122.

The protrusions 112 protrude outward from the outer circumferential surface of the housing 110. A plurality of protrusions 112 may be spaced apart from each other along the circumference of the housing 110. For example, the protrusion 112 may be formed at the lower end edge of the housing 110 and may be inserted into the protrusion receiving portion 122*b* of the flange portion 122*a*.

The drainage pump 100 further includes a first rib 130 provided on an inner circumferential surface of the housing 110. The first rib 130 protrudes from the inner circumferential surface of the housing 110 in a center direction or an inner direction of the receiving space 111.

Particularly, the first rib 130 is formed on the inner circumferential surface of the housing 110 corresponding to a portion between the circulation port 114 and the drainage port 115. At this time, the first rib 130 protrudes from the inner circumferential surface of the housing 110 in a center direction of the receiving space 111 and extends in the vertical direction of the housing 110.

In addition, the first ribs 130 extend in the circumferential direction of the housing 110. Accordingly, the first rib 130 may have a length in a direction from the inner circumferential surface of the housing 110 toward the center of the housing 110, that is, a first thickness Tl between from an outer surface of the first rib 130 facing the inner circumferential surface of the housing 110 and an inner surface of the first rib 130 facing the impeller 121.

The first rib 130 is disposed radially outward of the impeller 121. In other words, the first rib 130 protrudes to be close to the outer circumferential surface of the impeller 121 from the inner circumferential surface of the housing 110.

The first rib 130 serves to suppress the formation of the vortex generated by the flow of water or wash water in the housing 110.

Specifically, when the impeller 121 is rotated, water or wash water received in the housing 110 flows and vortex, which is a swirling flow of the fluid, may be generated. However, the water flowing in the radial direction of the impeller 121 may be discharged only to the circulation port 114 or the drainage port 115 by the shape of the partition of the first rib 130 located between the circulation port 114 and the drainage port 115.

In other words, the first rib 130 suppresses the formation of the vortex generated during rotation of the impeller 121, thereby preventing backflow of water or wash water to the drainage port 115 in the circulation process, and preventing backflow of water or wash water into the circulation port 114 in the drainage process.

When water or wash water flows backward into the drainage port 115 in the circulation process, a problem that the amount of water for circulating to the tub 15 is reduced is generated. However, since the moving of the water to the circulation port 114 or the drainage port 115 is smoothly performed by the first rib 130 according to the present disclosure, there is an advantage that the backflow of water is prevented.

In some implementations, the drainage pump 100 may include a second rib 140 further protruding from the first rib 130 in the center direction of the receiving space 111. The second rib 140 protrudes from an inner surface of the first rib 130 toward the suction port 113. The inner surface of the first rib 130 faces the impeller 121.

Specifically, the second rib 140 may protrude from the inner surface of the first rib 130 to a space between the suction port 113 and the impeller 121. The second rib 140 protrudes from the upper portion of the first rib 130 in the center direction of the receiving space 111 and may extend in the circumferential direction along the rounded inner surface of the first rib 130.

Accordingly, the second rib 140 may have a length in a direction from the inner surface of the first rib 130 toward the center of the housing 110, that is, a second thickness T2. Here, the protrusion thickness T2 of the second rib 140 may be greater than or equal to the protrusion thickness T1 of the first rib 130.

The distance L1 from the center of the suction port 113 or the rotation center C of the impeller 121 to the first rib 130 is 0.8 to 1.0 times a length of the inner diameter D1 of the housing 110.

In addition, the distance L2 from the center of the suction port 113 or the rotation center C of the impeller 121 to the second rib 140 is 0.5 to 0.7 times a length of the inner diameter D1 of the housing 110.

According to one implementation, the lower surface of the second rib 140, that is, the surface of the second rib 140 facing the impeller 121 is formed to be inclined.

Specifically, the second rib 140 may include a first surface 141 connected to an inner surface of the first rib 130, a second surface 142 connecting the first surface 141 and the inner surface of the housing 110 with each other, a third surface 143 extending downward from an end portion of the second surface 142, and a fourth surface 144 connecting the first surface 141 and the third surface 143 with each other.

Here, the first surface 141 is positioned on the first rib 130 and the second surface 142 can be extended from the upper-end portion of the first surface 141 in the center direction of the housing 110. The second surface 142 may be in contact with the inner surface of the upper surface 111*a* of the housing 110.

The vertical length or the axial length of the first surface 141 is formed to be longer than the length of the third surface 143 in the vertical direction or the axial direction. Therefore, the fourth surface 144 connecting the lower end portion of the first surface 141 and the lower end portion of the third surface 143 may be formed to be inclined.

The reason why the lower surface of the second rib 140, that is, the fourth surface 144 is formed to be inclined is to further limit the formation of the vortex generated during rotation of the impeller 121 to prevent the fluid from flowing backward. In other words, the water moving in the radial direction of the impeller 121 is interfered or resisted by the first rib 130 and the second rib 140, so that the vortex generated during rotation of the impeller 121 can be significantly reduced.

In addition, the fourth surface 144 of the second rib 140 may have an inclination angle of 15° to 25°. For example, an angle formed by an imaginary line P1 passing through the first surface 141 and an imaginary line P2 passing through the fourth surface 144 can be 15° to 25°. In other words, the fourth surface 144 is formed to be inclined from the lower portion to the upper portion, thereby effectively suppressing the formation of the vortex.

In some implementations, the drainage pump 100 may further include an inflow guide surface 113*a* formed on the inner side of the housing 110.

When the fluid flows into the receiving space 111 through the suction port 113, the inflow guide surface 113*a* has a function of smoothly moving the fluid to limit the formation of the vortex and in which the impeller 121 can sufficiently receive the fluid.

Specifically, the inflow guide surface 113*a* is formed inside the suction port 113. The inflow guide surface 113*a* is rounded so as to have a constant curvature at the inside of the suction port 113. In other words, a portion at which the inner surface of the suction port 113 and the inner surface of the upper surface 111*a* of the housing 110 are connected to each other is rounded to have a predetermined curvature and thus the inflow guide surface 113*a* is formed. At this time, the radius of curvature R of the inflow guide surface 113*a* may be formed to be 2 mm to 5 mm.

Therefore, the flow sectional area of the suction port 113 is formed so as to gradually increase from the inlet side to the outlet side. In other words, the outer diameter D2 of the suction port 113 is formed such that the outlet side is larger than the inlet side. In this case, since the suction port shape is curved so that the fluid can flow smoothly, the suction flow rate can be increased and the noise due to fluid movement can be significantly reduced.

Figure 6:
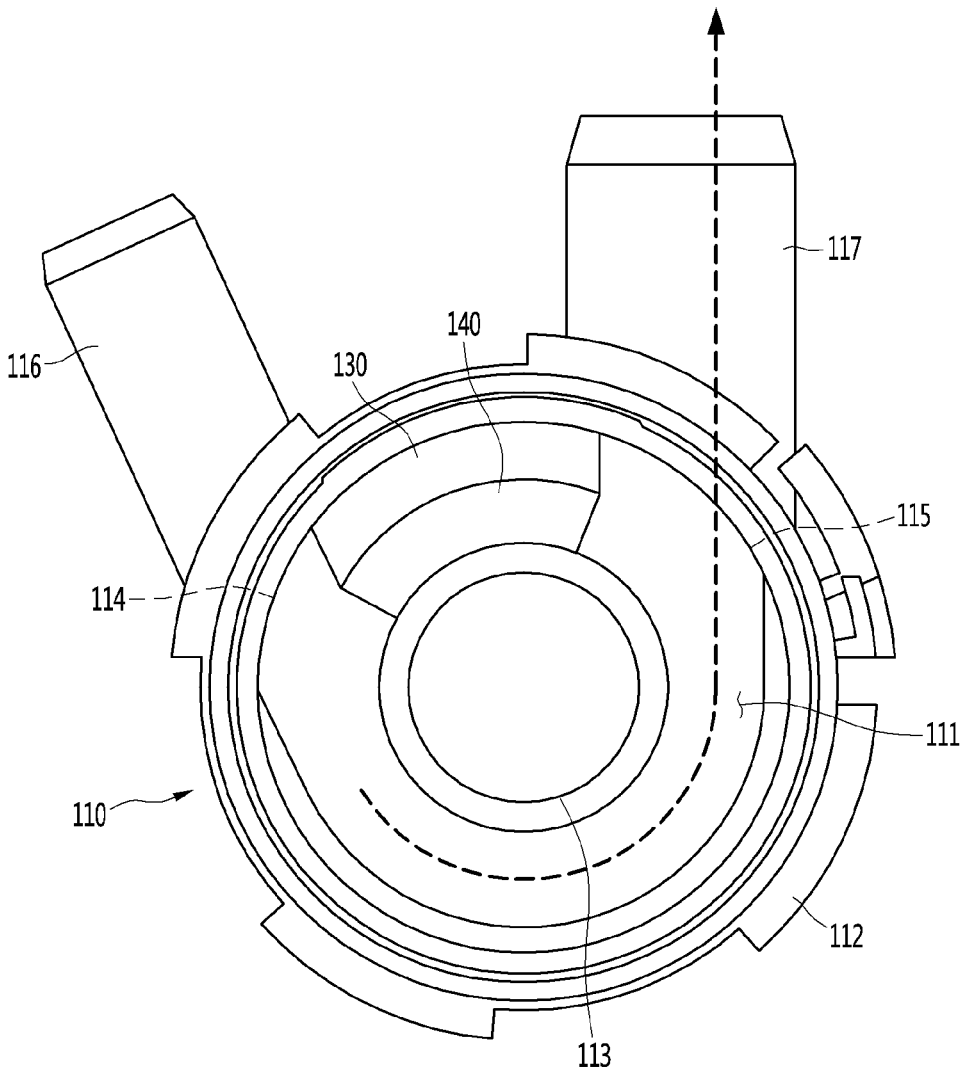
FIG. 6 is a view illustrating an example of a drainage process of the drainage pump.
Figure 7:
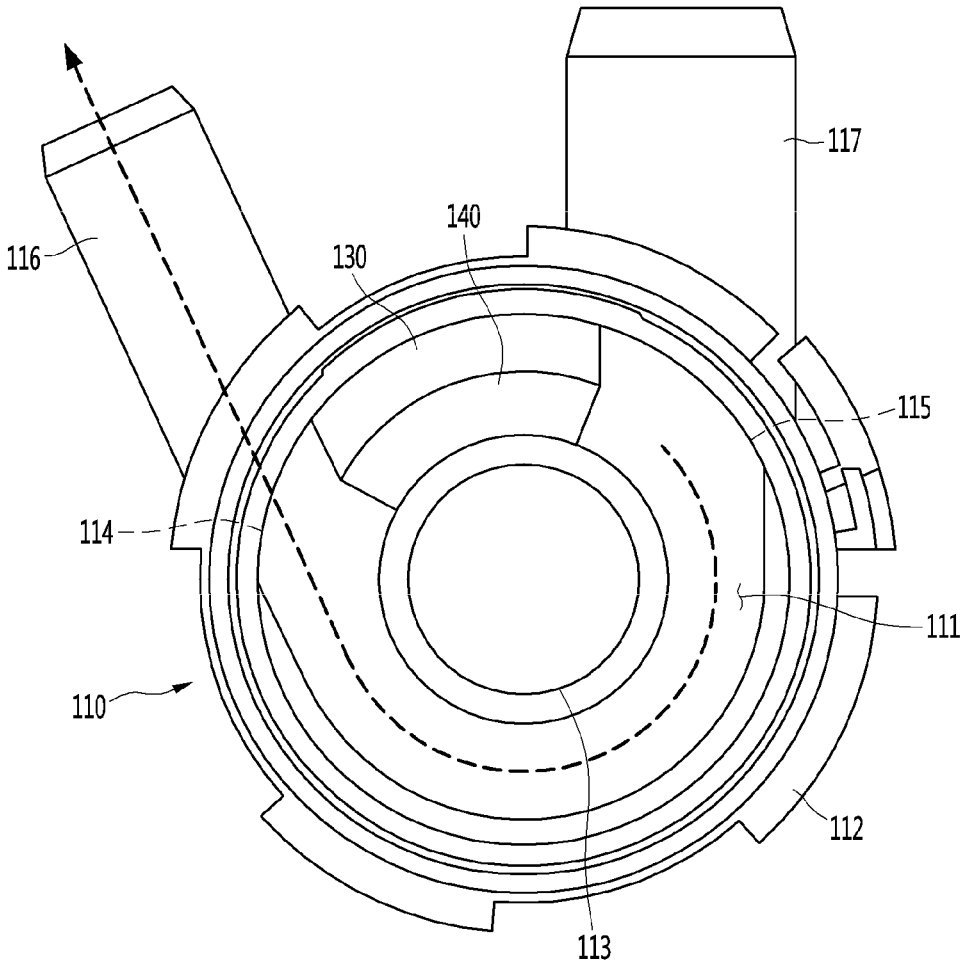
FIG. 7 is a view illustrating an example of a circulation process of the drainage pump.

FIG. 6 is a view illustrating an example of a drainage process of the drainage pump, and FIG. 7 is a view illustrating an example of a circulation process of the drainage pump.

Referring to FIG. 6 and FIG. 7, when the water or wash water stored in the tub 15 flows into the drainage pump 100, the drainage pump 100 can perform a drainage process of discharging the introduced water or wash water by the driving of the motor to the outside and a circulation process of circulating the introduced water or the wash water to the tub 15.

As illustrated in FIG. 6, in a case where the drainage pump 100 performs a drainage process, the water stored in the tub 15 flows through the suction hose 20 into the housing 110 of the drainage pump 100. At the same time, the impeller 121 is rotated in the counterclockwise direction.

The water flowing into the housing 110 flows in the axial direction of the impeller 121, flows in the counterclockwise direction due to the rotation of the impeller 121 and then can be discharged through the drainage port 115 and the drainage pipe 117 to the outside.

Particularly, in a process in which the water flowing in the housing 110 rotates in the counterclockwise direction, the formation of the vortex is minimized by the first rib 130 and the second rib 140 formed between the circulation port 114 and the drainage port 115. Accordingly, during the drainage process, the backflow of the water to the circulation port 114 and the circulation pipe 116 is prevented and fluid flow can be smoothly performed to increase the suction flow rate.

In some implementations, an inflow guide surface 113*a* for widening the flow sectional area is formed inside the suction port 113 of the housing 110 so that when the fluid flows into the receiving space 111 through the suction port 113, the movement of the flow is smooth and thus the impeller 121 sufficiently receives the fluid.

In other words, since the inflow guide surface 113*a* is rounded so that the flow sectional area increases from the inlet side to the outlet side of the suction port 113, the suction flow rate of the drainage pump 100 increases and the formation of the vortex is minimized.

As illustrated in FIG. 7, the water stored in the tub 15 flows in the housing 110 of the drainage pump 100 through the circulation hose 30 in a case where the drainage pump 100 performs the circulation process. At the same time, the impeller 121 is rotated in the clockwise direction.

The water flowing into the housing 110 flows in the axial direction of the impeller 121, flows in the clockwise direction by the rotation of the impeller 121 and then can be discharged through the circulation port 114 and the circulation pipe 116 to the outside.

Particularly, in a process in which the water flowing in the housing 110 rotates in the clockwise direction, the formation of the vortex is minimized by the first rib 130 and the second rib 140 formed between the circulation port 114 and the drainage port 115. Accordingly, during the circulation process, the backflow of water to the drainage port 115 and the drainage pipe 117 is prevented, and the fluid movement can be smoothly performed so that the suction flow rate can be increased.

Figure 8:
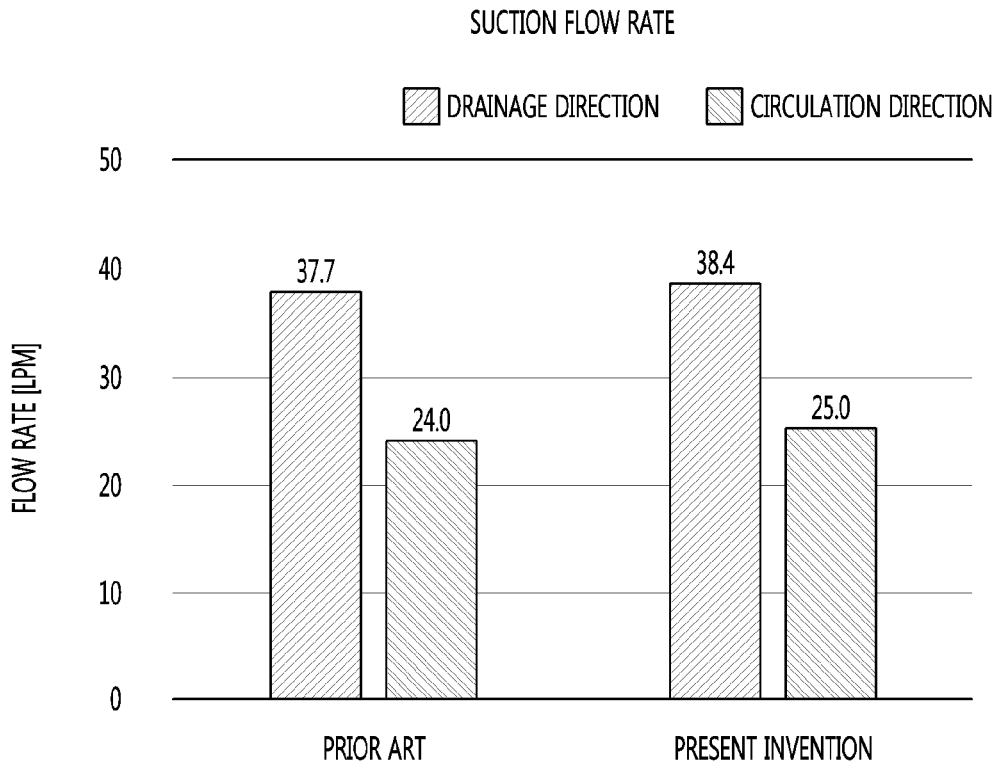
FIG. 8 is a graph illustrating an example of a suction flow rate effect of the drainage pump.

FIG. 8 is a graph illustrating an example of the suction flow rate effect of the drainage pump.

FIG. 8 illustrates a comparison of the suction flow rates in the drainage direction and the circulation direction of the drainage pump according to the present disclosure and the suction flow rates in the drainage direction and the circulation direction of the drainage pump according to the related art.

Referring to FIG. 8, the vertical axis of the graph represents a flow rate (Liter Per Minute, LPM) suctioned into the drainage pump per unit time.

Here, the flow rate suctioned into the drainage pump may mean a flow rate per unit time measured at the suction port 113.

Specifically, in the drainage process of the drainage pump according to the related art, the flow rate suctioned into the drainage pump represents 37.7 LPM. In addition, in the drainage process of the drainage pump according to the present disclosure, the flow rate suctioned into the drainage pump is 38.4 LPM. In other words, it can be seen that, in the present disclosure, the suction flow rate is increased by 0.7 LPM in the drainage process as compared with the related art.

In addition, in the circulation process of the drainage pump according to the related art, the flow rate suctioned into the drainage pump indicates 24 LPM. In addition, in the circulation process of the drainage pump according to the present disclosure, the flow rate suctioned into the drainage pump is 25 LPM. In other words, it can be seen that, in the present disclosure, the suction flow rate is increased by 1 LPM in the circulation process in comparison with the related art.

In summary, the drainage pump 100 according to the present disclosure illustrates a significant increase in the suction flow rate compared to the related art in both drainage and circulation processes.

Figure 9:
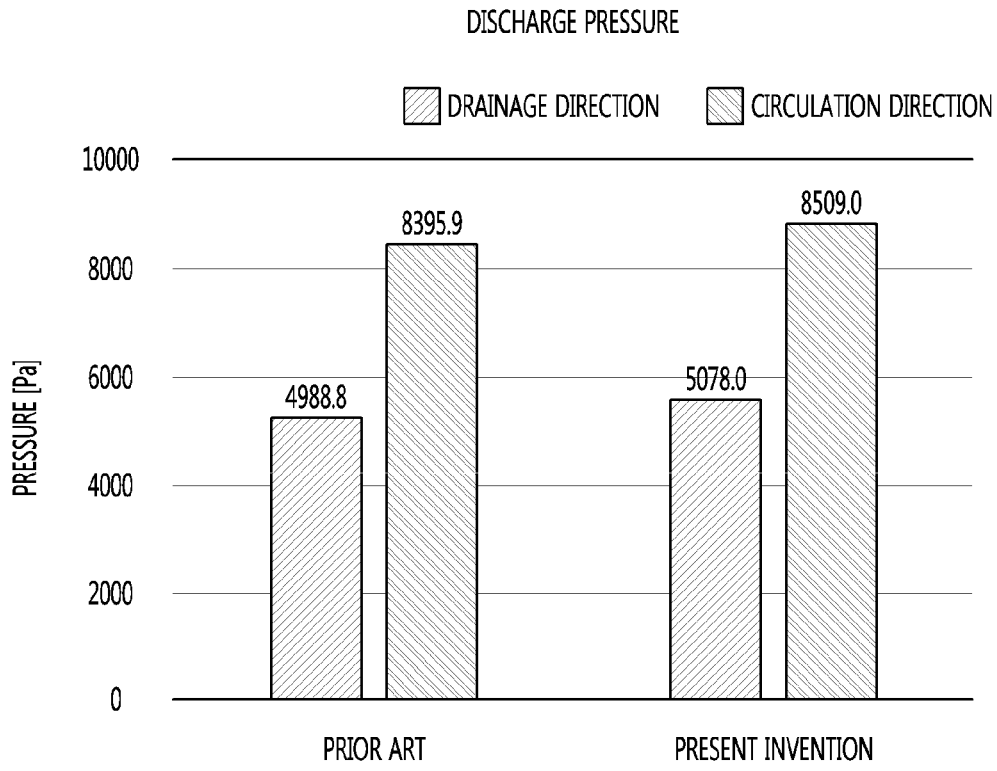
FIG. 9 is a graph illustrating an example of a discharge-side pressure of the drainage pump.

FIG. 9 is a graph illustrating an example of the discharge-side pressure of the drainage pump.

FIG. 9 illustrates a comparison of the discharge-side pressure in the drain direction and the circulation direction of the drainage pump according to the present disclosure and the discharge-side pressure in the drain direction and the circulation direction of the drainage pump according to the related art.

Here, the discharge-side pressure in the discharge direction may mean a pressure measured at the drainage port 115 or the drainage pipe 117 in the drainage process, and the discharge-side pressure in the circulation direction may mean a pressure measured at the circulation port 114 or the circulation pipe 116.

Referring to FIG. 9, the vertical axis of the graph represents Pascal (Pa) representing the force per unit time (pressure).

Specifically, the discharge-side pressure measured at the drainage process of the drainage pump according to the related art represents 4988.8 Pa. In addition, the discharge-side pressure measured at the drainage process of the drainage pump according to the present disclosure represents 5078.0 Pa. In other words, it can be seen that, in the present disclosure, the discharge-side pressure is increased by 89.2 Pa in the drainage process as compared with the related art.

In addition, the discharge-side pressure measured at the circulation process of the drainage pump according to the related art represents 8395.9 Pa. In addition, the discharge-side pressure measured at the circulation process of the drainage pump according to the present disclosure indicates 8509.0 Pa. In other words, it can be seen that, in the present disclosure, the discharge-side pressure is increased by 113.1 Pa in the circulation process as compared with the related art.

In summary, the drainage pump 100 may have a discharge-side pressure that is greater than that of the drainage pump of the related art in both the drainage process and the circulation process. Therefore, since the discharge-side pressure is larger in the drainage process and the circulation process, the pump performance and the suction flow rate may be improved.

Figure 10:
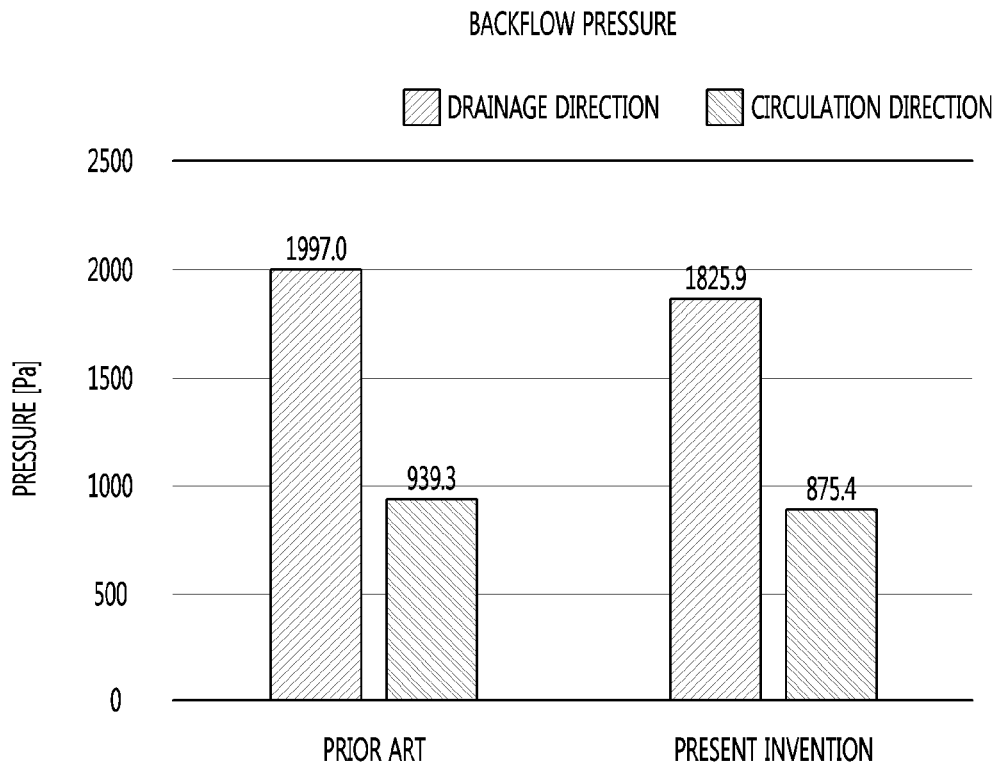
FIG. 10 is a graph illustrating an example of a backflow-side pressure of the drainage pump.

FIG. 10 is a graph illustrating an example of the backflow-side pressure of the drainage pump.

FIG. 10 illustrates a comparison of the backflow-side pressure in the drain direction and the circulation direction of the drainage pump according to the present disclosure and the backflow-side pressure in the drain direction and circulation direction of the drainage pump according to the related art.

In some implementations, the backflow-side pressure in the drainage direction may be a pressure measured at the circulation port 114 or the circulation pipe 116 in the drainage process, and the backflow-side pressure in the circulation direction may be a pressure measured at the drainage port 115 or the drainage pipe 117 in the circulation process.

Referring to FIG. 10, the vertical axis of the graph represents Pascal (Pa) representing the force per unit time (pressure).

Specifically, the backflow-side pressure measured at the drainage process of the drainage pump according to the related art represents 1997.0 Pa. The backflow-side pressure measured at the drainage process of the drainage pump according to the present disclosure represents 1825.9 Pa. In other words, it can be seen that, in the present disclosure, the backflow-side pressure is reduced by 171.1 Pa in the drainage process as compared with the related art.

In addition, the backflow-side pressure measured at the circulation process of the drainage pump according to the related art represents 939.3 Pa. The backflow-side pressure measured at the circulation process of the drainage pump according to the present disclosure represents 875.4 Pa. In other words, it can be seen that, in the present disclosure, the backflow-side pressure is decreased by 63.9 Pa in the circulation process as compared with the related art.

In summary, it can be seen that, in the drainage pump 100 according to the present disclosure, the backflow-side pressure is decreased as compared with the related art in both the drainage process and the circulation process. Therefore, since the backflow-side pressure is smaller in the drainage process and the circulation process, the effect that the backflow phenomenon of water or wash water is improved (minimized) can be expected.

Figure 11:
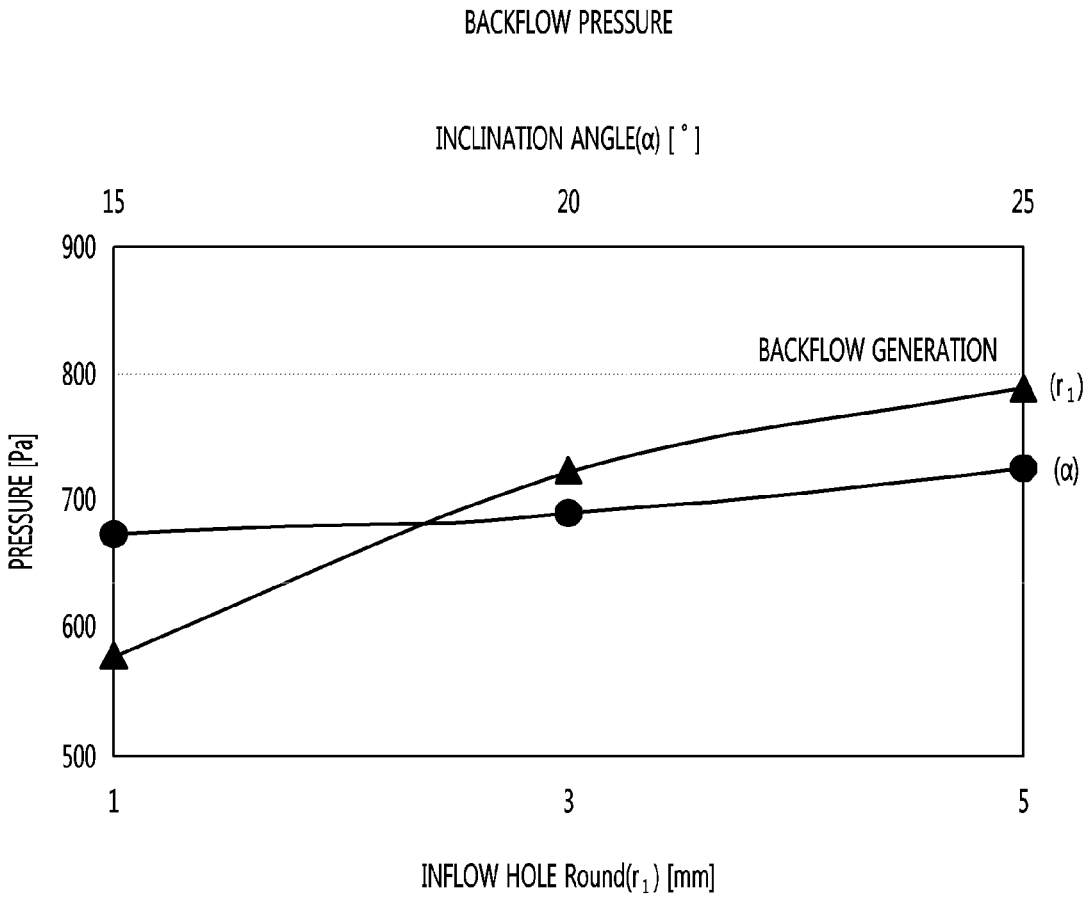
FIG. 11 is a graph illustrating an example of a change of the backflow-side pressure according to an inclination angle ($\alpha$) of the second rib and a radius of curvature (R) of the inflow guide surface in FIG. 4.
Figure 12:
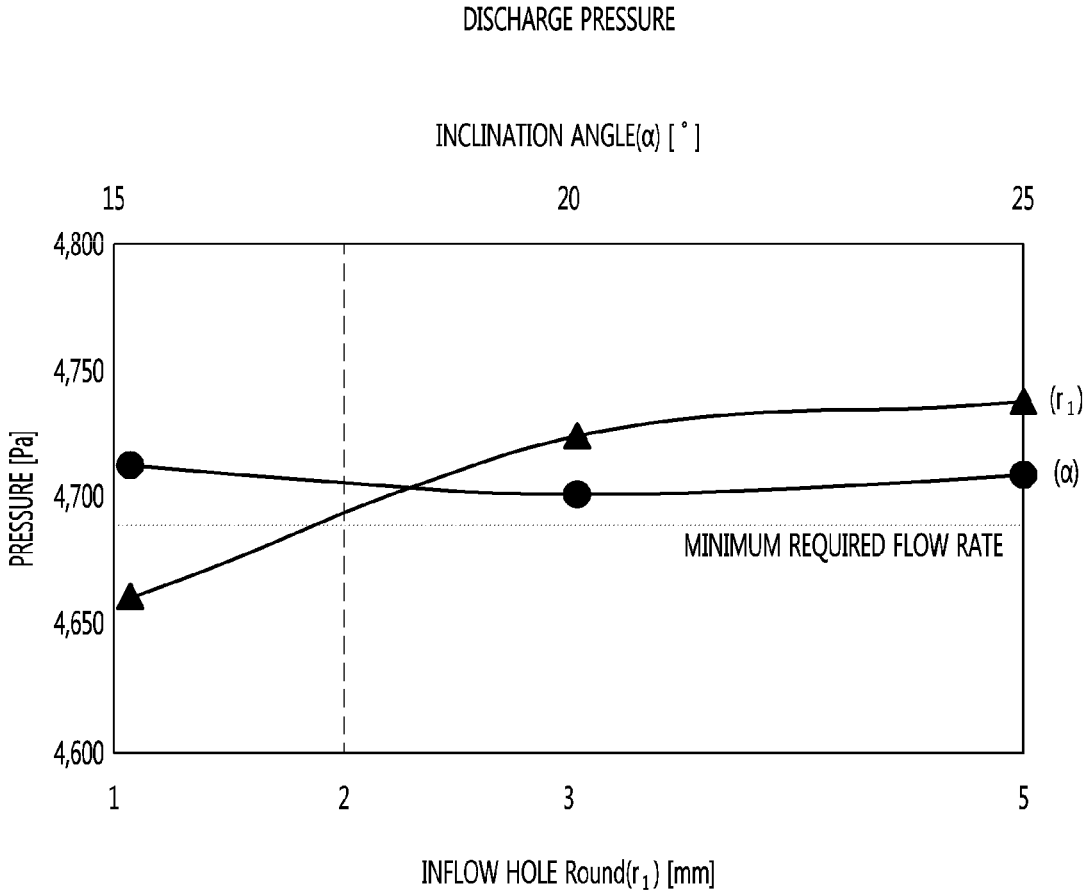
FIG. 12 is a graph illustrating an example of a change of the discharge-side pressure according to the inclination angle ($\alpha$) of the second rib and the radius of curvature (R) of the inflow guide surface in FIG. 4.

FIG. 11 is a graph illustrating an example of the backflow-side pressure according to an inclination angle of the second rib and a radius of curvature of an inflow guide surface, and FIG. 12 is a graph illustrating an example of the discharge-side pressure according to the inclination angle of the second rib and the radius of curvature of the inflow guide surface.

Here, the backflow-side pressure and the discharge-side pressure may be pressures measured at the circulation process of the drainage pump.

Referring to FIG. 11 and FIG. 12, a vertical axis of the graph represents Pascal (Pa) representing the force per unit time (pressure), a upper horizontal axis of the graph represents an inclination angle $\alpha$ of the second rib 140, and a lower horizontal axis of the graph represents a radius of curvature (mm) of the inflow guide surface 113*a*.

As described above, the second rib 140 according to the present disclosure further limits the formation of the vortex generated upon rotation of the impeller 121, thereby preventing the backflow of the fluid. To this end, the lower surface of the second rib 140, that is, the fourth surface 144 facing the impeller 121 is formed to be inclined.

However, if the inclination angle $\alpha$ of the second rib 140 is too small or too large, there is a problem that vortex is formed around the discharge-side or the backflow-side to cause a backflow of the fluid. Accordingly, the inclination angle $\alpha$ of the second rib 140 needs to be appropriately designed.

In the present disclosure, the inclination angle $\alpha$ of the second rib 140 is set to15° to 25°, thereby maintaining the discharge pressure and preventing the generation of the backflow.

In some implementations, the inflow guide surface 133*a* may have a function of increasing the suction flow rate and reducing the noise due to fluid movement by widening the outlet-side flow sectional area than the inlet-side flow sectional area of the suction port 113.

In some examples, where the radius of curvature r of the inflow guide surface 133*a* is too small, the discharge pressure decreases and the suction flow rate may decrease. In some examples, where the radius of curvature r is too large, the backflow-side pressure may increase and backflow may be generated.

For example, in some cases, where the radius of curvature r of the inflow guide surface 133*a* exceeds 5 mm, the backflow-side pressure may increase and the backflow may be generated. In some cases, where the radius of curvature r of the inflow guide surface 133*a* is less than 2 mm, the minimum required flow rate of the pump may not be satisfied.

In some implementations, the radius of curvature r of the inflow guide surface 133*a* is set to be 2 mm to 5 mm, thereby satisfying the minimum required flow rate and preventing the generation of the backflow.

According to the drainage pump and the cloth treating apparatus of an implementation of the present disclosure having the configuration described above, the following effects can be obtained.

In some implementations, where a first rib protrudes in the center direction of the receiving space is formed between the first discharge port and the second discharge port formed in the drainage pump housing, there is an advantage that the formation of the vortex generated during rotation of the impeller is suppressed.

In some implementations, where a second rib protruding from the first rib in the center direction of the receiving space is additionally provided, the formation of the vortex can be further limited. In other words, since the formation of the vortex is minimized, the backflow of the water in the circulation process, and the drainage process can be prevented, and at the same time, the minimum required flow rate can be ensured and the washing performance can be improved.

In some implementations, where the inlet guide surface is rounded to have a constant curvature and disposed inside the suction port of the housing, the flow sectional area of the suction port may gradually increase from the inlet side to the outlet side. Accordingly, the suction port shape may become curved so that the fluid can smoothly flow, and as a result, the fluidity can be improved, so that the suction flow rate can be increased and the noise can be reduced.

In some implementations, where the water flowing into the drainage pump is selectively moved to the circulation port or the drainage port in accordance with the rotation direction of the motor, there is an advantage that the cost can be saved as compared with a separate implementation of the drainage pump and the circulation pump.

Although implementations have been described with reference to a number of illustrative implementations thereof, it should be understood that numerous other modifications and implementations can be devised by those skilled in the art that will fall within the spirit and scope of the principles of this disclosure. More particularly, various variations and modifications are possible in the component parts and/or arrangements of the subject combination arrangement within the scope of the disclosure, the drawings and the appended claims. In addition to variations and modifications in the component parts and/or arrangements, alternative uses will also be apparent to those skilled in the art.

What is claimed is:

1. A drainage pump comprising:

a housing that defines a receiving space configured to receive fluid, the housing defining:

a suction port disposed at an upper surface of the housing and configured to introduce fluid into the receiving space, and a first discharge port and a second discharge port that are spaced apart from each other in a circumferential direction of the housing and configured to discharge the fluid in the receiving space to an outside of the housing;

an impeller disposed in the receiving space and configured to rotate about a rotation axis to thereby discharge the fluid in the receiving space through the first discharge port or the second discharge port, the impeller facing the suction port;

a first rib that protrudes from an inner circumferential surface of the housing toward a center of the receiving space and that is disposed between the first discharge port and the second discharge port, the first rib being disposed between the impeller and the inner circumferential surface of the housing; and a second rib that protrudes from a portion of the first rib toward the center of the receiving space, the second rib extending from an inner surface of the first rib to a space defined between the suction port and the impeller.

2. The drainage pump of claim 1, wherein the first rib is disposed radially outward of the impeller.

3. The drainage pump of claim 1, wherein the impeller comprises a rotation shaft that extends along the rotation axis, and the rotation axis passes through a center of the suction port.

4. The drainage pump of claim 1, further comprising:

a circulation pipe that extends from the first discharge port to the outside of the housing; and a drainage pipe that extends from the second discharge port to the outside of the housing.

5. The drainage pump of claim 2, wherein the first rib has a first thickness in a radial direction of the housing with respect to the inner circumferential surface of the housing.

6. The drainage pump of claim 5, wherein the second rib has a second thickness in the radial direction with respect to the inner surface of the first rib.

7. The drainage pump of claim 6, wherein the second thickness of the second rib is greater than or equal to the first thickness of the first rib.

8. The drainage pump of claim 2, wherein the second rib defines an inclined surface facing the impeller.

9. The drainage pump of claim 2, wherein the second rib comprises:

a first surface that contacts the inner surface of the first rib;

a second surface that extends from the first surface and that contacts an inner surface of the housing;

a third surface that extends from an end portion of the second surface; and a fourth surface that extends from the first surface in a direction inclined with respect to the first surface, that connects to the third surface, and that faces the impeller.

10. The drainage pump of claim 9, wherein the first surface and the fourth surface defines an inclination angle in a range from 15° to 25°.

11. The drainage pump of claim 1, wherein an inner diameter of the housing is in a range from 1.1 to 1.5 times an outer diameter of the impeller.

12. The drainage pump of claim 1, wherein an inner diameter of the suction port is in a range from 0.5 to 0.7 times an outer diameter of the impeller.

13. The drainage pump of claim 1, wherein a radial distance between the inner surface of the first rib and a center of the suction port or a rotation shaft of the impeller is in a range from 0.8 to 1.0 times an inner diameter of the housing.

14. The drainage pump of claim 1, wherein a radial distance between an inner surface of the second rib and a center of the suction port or a rotation shaft of the impeller is in a range from 0.5 to 0.7 times an inner diameter of the housing.

15. The drainage pump of claim 2, wherein a sectional area of the suction port increases as the suction port extends from an inlet side facing the outside of the housing to an outlet side facing the impeller.

16. The drainage pump of claim 2, wherein the suction port defines an inflow guide surface at an inside of the suction port, the inflow guide surface having a predetermined curvature.

17. The drainage pump of claim 16, wherein a radius of curvature of the inflow guide surface is in a range from 2 mm to 5 mm.

18. A cloth treating apparatus comprising:

a cabinet that defines an outer appearance of the cloth treating apparatus;

a tub disposed inside the cabinet and configured to receive wash water;

a drum disposed inside the tub and configured to receive laundry;

a pulsator rotatably installed in the drum;

a driving unit configured to rotate the pulsator or the drum; and a drainage pump disposed outside the tub and configured to drain or circulate wash water discharged from the tub, the drainage pump comprising:

a housing that defines a receiving space configured to receive fluid, the housing defining a suction port that is disposed at an upper surface of the housing and configured to introduce fluid into the receiving space, and a first discharge port and a second discharge port that are spaced apart from each other in a circumferential direction of the housing and configured to discharge the fluid in the receiving space to an outside of the housing, an impeller disposed in the receiving space and configured to rotate about a rotation axis to thereby discharge the fluid in the receiving space through the first discharge port or the second discharge port, the impeller facing the suction port, a first rib that protrudes from an inner circumferential surface of the housing toward a center of the receiving space and that is disposed between the first discharge port and the second discharge port, the first rib being disposed between the impeller and the inner circumferential surface of the housing, and a second rib that protrudes from a portion of the first rib toward the center of the receiving space, the second rib extending from an inner surface of the first rib to a space defined between the suction port and the impeller.

19. The drainage pump of claim 1, wherein the second rib is inclined with respect to the inner surface of the first rib and extends upward from an upper portion of the inner surface of the first rib toward the suction port, and wherein the second rib contacts an upper inner surface of the housing and extends along the upper inner surface of the housing toward the space defined between the suction port and the impeller.

20. A drainage pump comprising:

a housing that defines a receiving space configured to receive fluid, the housing defining:

a suction port configured to introduce fluid into the receiving space, and a first discharge port and a second discharge port that are configured to discharge the fluid in the receiving space to an outside of the housing;

an impeller disposed in the receiving space and configured to rotate about a rotation axis to thereby discharge the fluid in the receiving space through the first discharge port or the second discharge port, the impeller facing the suction port;

a first rib that protrudes from an inner circumferential surface of the housing toward a center of the receiving space and that is disposed between the first discharge port and the second discharge port, the first rib being disposed radially outward of the impeller; and a second rib that protrudes from a portion of the first rib toward the center of the receiving space, wherein the second rib comprises:

a first surface that contacts an inner surface of the first rib, a second surface that extends from the first surface and that contacts an inner surface of the housing, a third surface that extends from an end portion of the second surface, and a fourth surface that extends from the first surface in a direction inclined with respect to the first surface, that connects to the third surface, and that faces the impeller.

* * * * *